US006256954B1

(12) United States Patent
Thooft

(10) Patent No.: US 6,256,954 B1
(45) **Date of Patent: *Jul. 10, 2001**

(54) COMBINATION REINFORCEMENT FOR FLOOR ON PILES

(75) Inventor: Hendrik Thooft, Zingem (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/290,244

(22) Filed: Apr. 13, 1999

(30) Foreign Application Priority Data

Jun. 11, 1998 (EP) ..... 98201955

(51) Int. Cl.[7] ..... E02D 5/34

(52) U.S. Cl. ..... 52/299; 52/294; 52/296; 52/649.2; 52/649.1; 405/229

(58) Field of Search ..... 52/299, 294, 296, 52/649.1, 649.2; 405/229, 230, 231, 256

(56) References Cited

U.S. PATENT DOCUMENTS

| | | | | |
|---|---|---|---|---|
| 776,419 | | 11/1904 | Platt . | |
| 1,363,273 | * | 12/1920 | Ruff | 52/299 |
| 2,413,562 | * | 12/1946 | Henderson | 52/296 |
| 2,998,216 | * | 8/1961 | Hurd | 52/294 |
| 3,087,308 | | 4/1963 | Hart et al. . | |
| 3,184,893 | | 5/1965 | Booth . | |
| 3,706,168 | * | 12/1972 | Pillish | 52/294 X |
| 3,918,229 | * | 11/1975 | Schweinberger | 52/296 X |
| 4,007,568 | * | 2/1977 | Soble | 52/294 |
| 4,031,687 | | 6/1977 | Kuntz . | |
| 4,275,538 | * | 6/1981 | Bounds | 52/299 |
| 4,594,825 | * | 6/1986 | Lamarca | 52/294 X |
| 4,799,348 | | 1/1989 | Brami et al. . | |
| 4,886,399 | | 12/1989 | Pidgeon . | |
| 4,899,497 | | 2/1990 | Madl, Jr. . | |
| 5,337,533 | * | 8/1994 | Kajita | 52/294 X |
| 5,367,845 | * | 11/1994 | Hartling | 52/294 X |
| 5,699,643 | * | 12/1997 | Kinard | 52/742.14 |

FOREIGN PATENT DOCUMENTS

| | | |
|---|---|---|
| 29 52 783 | 7/1981 | (DE) . |
| 0 121 003 | 10/1984 | (EP) . |
| 1105259 | 11/1955 | (FR) . |
| 2112508 | 6/1972 | (FR) . |
| 2160180 | 6/1973 | (FR) . |
| 2220643 | 10/1974 | (FR) . |
| 252975 | 6/1926 | (GB) . |
| WO 95/35415 | 12/1995 | (WO) . |
| WO 98/36138 | 8/1998 | (WO) . |

OTHER PUBLICATIONS

European Search Report (Application No. EP 98 20 1955).

* cited by examiner

*Primary Examiner*—Carl D. Friedman
*Assistant Examiner*—Phi Dieu Tran A
(74) *Attorney, Agent, or Firm*—Shlesinger, Arkwright & Garvey LLP

(57) ABSTRACT

A fixed construction (10) comprises rigid piles (12) and a monolithic concrete floor slab resting (14) on the piles. The floor slab comprises straight zones connecting in the two directions, i.e. lengthwise and broadwise, the shortest distance between the areas of the floor slab above the piles. The floor slab (14) is reinforced by a combination of: (a) fibers (22) distributed over the volume of the floor slab (14); (b) and steel rods (16, 16') with a yield strength of at least 690 MPa and being located in those straight zones.

This construction reduces considerably the amount of reinforcement steel, increases the bearing capacity and enables to reduce the time for making such a construction.

22 Claims, 3 Drawing Sheets

COMBINATION REINFORCEMENT FOR FLOOR ON PILES

FIELD OF THE INVENTION

The present invention relates to a fixed construction which comprises rigid piles and a monolithic concrete floor slab.

BACKGROUND OF THE INVENTION

Concrete industrial floor slabs usually rest via a foundation layer on a natural ground. Unevenly distributed loads on top of the floor slab are transmitted via the floor slab and the foundation layer in a more evenly distributed form through to the natural ground, which eventually bears the load.

Natural grounds of an inferior quality, e.g. characterized by a Westergaard K-value of less than 10 MPa/m, are first dug up and/or tamped down and leveled before the foundation is laid over it.

Due to the fact that a lot of natural grounds of good quality (characterized by a high Westergaard K-value) have already been taken for existing constructions, the number of natural grounds with inferior or even unacceptable quality (i.e. with a low Westergaard K-value) which are being considered for constructions is increasing. The bearing capacity of some grounds is so bad that digging up and/or excavating and/or tamping down would constitute an enormous amount of work and cost.

In such a case it is known to rest the floor slab on driven or bored piles. Placing a floor slab on driven or bored piles under load, however, creates very high negative peak moments in the areas above these piles and relatively much lower (about one fifth of the height of the peak moments) positive moments in the zones between the piles. Reinforcing floor slabs on driven or bored piles with uniformly distributed steel fibres would not be economical since the zones between the piles would have a quantity of steel fibres which is unnecessarily too high and which would cause trouble during the pumping and pouring of the concrete and would render the solution not economical.

This problem has been solved in FR 2 718 765 of applicant, by having the floor slab rest on a number of gravel columns. As has been explained therein, these gravel columns are not as rigid as common piles and compress relatively easily under a downward load (the compression modulus of gravel columns e.g. ranges from 0.2 to 0.4 MN/cm) so that the gravel columns function like a spring in a mathematical model, which means that the floor slab is no longer subjected to high bending deformations in the zones above the columns.

In the international application PCT/EP98/00719 of applicant a solution has been disclosed to the above-mentioned problem. The present invention involves an improvement of the invention disclosed in this international application.

SUMMARY OF THE INVENTION

The present invention provides an alternative reinforcement for concrete floor slabs resting on piles which saves weight of steel and which prevents introduction of high amounts of steel fibres into the floor slab. Another object of the present invention is to provide a reinforcement for concrete floor slabs resting on piles where the reinforcement functions as a tensile anchor for taking up shrinkage cracks.

Still another object of the present invention is to save time in constructing a concrete floor slab resting on piles.

In comparison with the invention disclosed in PCT/EP98/00719, the present invention provides a greater weight savings in steel and a greater and more reduction in time required to construct the concrete floor.

According to the present invention there is provided a fixed construction which comprises rigid piles and a monolithic concrete floor slab which rests on the piles. The rigid piles are arranged in a regular rectangular pattern, i.e. each set of four piles forms a rectangle. The floor slab comprises straight zones which connect the shortest distance between the areas of the floor slab above the piles. The width of such zones ranges from 50% to 500% the largest dimension of the piles. These straight zones run both lengthwise and broadwise. The term "lengthwise" refers to the direction of the longest side and the term "broadwise" refers to the direction of the smallest side. If, such as is often the case, the longest side is about equal to the shortest side, the terms broadwise and lengthwise are arbitrarily designated to the two directions.

The floor slab is reinforced by a combination of:

(a) fibres which are distributed over the volume of the floor slab;

(b) steel bars with a yield strength above 690 MPa and which are located in those straight zones, and preferably only in those straight zones, which means that outside these zones there is no substantial reinforcement except for the fibres under (a).

The term "rigid piles" refers to piles the compression modulus of which is much greater than the compression modulus of gravel columns and is much greater than 10 MN/cm. These rigid piles are driven or bored piles and may be made of steel, concrete or wood. They may have a square cross-section with a side of 20 cm or more, or they may have a circular cross-section with a diameter ranging between 25 cm and 50 cm. The distance between two adjacent piles may vary from 2.5 m to 6 m.

The term "yield strength" is herein defined as the strength at a permanent elongation of 0.2%.

By using this combination reinforcement constituted by fibres and a classical steel rod reinforcement which is only located in the critical points of the floor slab, it has proved to be possible to limit the total amounts of steel fibres in the concrete slab from about 120 kg/m$^3$ (=1.53 vol. %) until a concentration ranging from about 30 kg/m$^3$ (=0.38 vol. %) to about 80 kg/m$^3$ (=1.02 vol. %), or even lower.

A floor slab is an industrial floor with dimensions up to 60 m×60 m and more, and—due to the continuous rod reinforcement—carried out without joints, i.e. without control joints, isolation joints, construction joints or shrinkage joints.

The thickness of the floor slab may range from about 14 cm to 35 cm and more.

Of course, in order to cover large surfaces more than one such a jointless floor slab may be put adjacent to each other. With the present invention, i.e. with the combination of both fibres and continuous rods it has proved possible to eliminate expansion joints when constructing such a second (and a third . . .) jointless floor slab adjacent to the first one. This is done by reinforcing the transition zone from one floor slab to the other by means of a metal netting.

Preferably the floor slab "directly" rests on the piles. This refers to a floor slab which rests on the piles without any intermediate beams or plates. All reinforcement is embedded in the floor slab itself.

The fibres in the floor slab are preferably uniformly distributed in the concrete of the floor slab. The fibres may be synthetic fibres but are preferably steel fibres, e.g. steel fibres cut from steel plates or, in a preferable embodiment, hard drawn steel fibres. These fibres have a thickness or a diameter varying between 0.5 and 1.2 mm, and a length-to-thickness ratio ranging from 40 to 130, preferably from 60 to 100. The fibres have mechanical deformations such as ends as hook shapes, thickenings or undulations in order to improve the anchorage to the concrete. The tensile strength of the steel fibres ranges from 800 to 3000 MPa, e.g. from 900 to 1400 MPa. The amount of steel fibres in the floor slab of the invention preferably ranges from 30 kg/m$^3$ (0.38 vol. %) to 80 kg/m$^3$ (1.02 vol. %), e.g. from 40 kg/m$^3$ (0.51 vol. %) to 65 kg/M$^3$ (0.83 vol. %). So the amount of steel fibres in a concrete floor slab according to the invention is preferably somewhat higher than steel fibre reinforced floors on natural ground of good quality (normal amounts up to 35 kg/m$^3$), but can be kept within economical limits due to the combination with the higher tensile steel rod reinforcement.

The other steel reinforcement in addition to the steel fibres, the steel rods'are preferably hard drawn and occupy maximum 0.4% of the total volume of the floor slab, e.g. maximum 0.3%, e.g. only 0.2% or 0.3%. The diameter of the steel rods ranges from about 3.5 mm to about 12.0 mm.

The minimum yield strength of the steel rods is 690 MPa, but higher values of this yield strength are obtainable, particularly for rods with smaller diameters. Yield strengths of 800 MPa, 1000 MPa and 1200 MPa are obtainable.

Both steel reinforcements, the steel fibres and the steel rods, preferably occupy maximum 1.5% of the total volume of the floor slab, e.g. maximum 1.2%.

In a preferable embodiment of the present invention, the steel rods are arranged in pairs. For example, in each of the straight zones one pair of rods is located.

The rods of each pair are parallel and may be connected by means of transverse steel elements. These transverse steel element are conveniently made of a softer steel, i.e. a steel with a carbon content which is lower than the carbon content of the steel rods. This allows one to make perfect welded joints between the transverse steel elements and the steel rods. In this way the combination longitudinal rod—transverse steel element forms a "bi-steel strip".

The transverse steel elements may be round in cross-section or flat. In the latter case, the flat face forms a right angle with the longitudinal axis of the rods. The flat face prevents a transmission of oblique forces to the concrete.

The presence of the transverse steel elements helps to improve the anchorage in the concrete.

The distance between two parallel rods in each pair is about the same order of magnitude as their diameter, about equal for rods with a diameter of more than 20 mm, but not less than 20 mm for rods with a diameter less than 20 mm. A spacing ranging between 20 mm and 30 mm is suitable in most circumstances. Typical values are 20 mm and 23 mm.

The interval between the transverse steel elements is usually higher than the distance between the longitudinal rods but does not exceed 200 mm. A typical value is 95 mm.

Preferably the pair of rods are placed and supported by means of spacers which can be made of a synthetic material.

BRIEF DESCRIPTION OF THE DRAWINGS

The invention will now be described into more detail with reference to the accompanying drawings wherein.

DESCRIPTION OF THE PREFERRED EMBODIMENT OF THE INVENTION.

Figure 1:
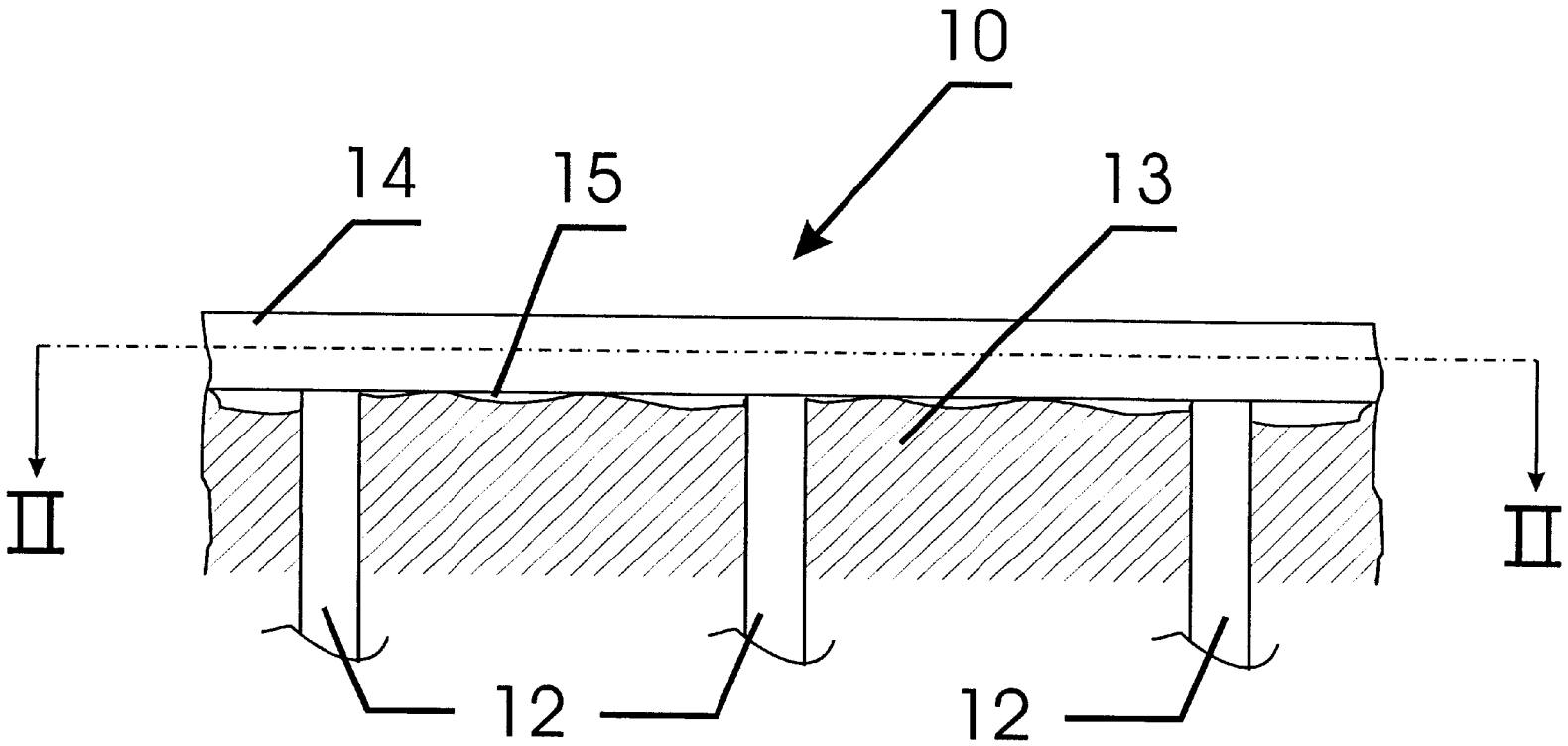
FIG. 1 is a transverse cross-sectional view of a fixed construction according to the invention according to line 1—1 of FIG. 2.

Referring to FIG. 1, a fixed construction according to the invention comprises rigid piles 12 which are driven or bored into the natural ground 13. A concrete floor slab 14 directly rests on the piles 12, i.e. without any intermediate plate or beam. The invention is particularly interesting for use on natural grounds of an inferior quality, i.e. with a Westergaard K-value of less than 10 MPa/m. In course of time, such natural grounds settle to a relatively high degree and no longer provide an adequate support for the floor slab 14. This is outlined by a distance 15 in FIG. 1. So the piles 12 remain the only reliable support for the floor slab 14.

Figure 2:
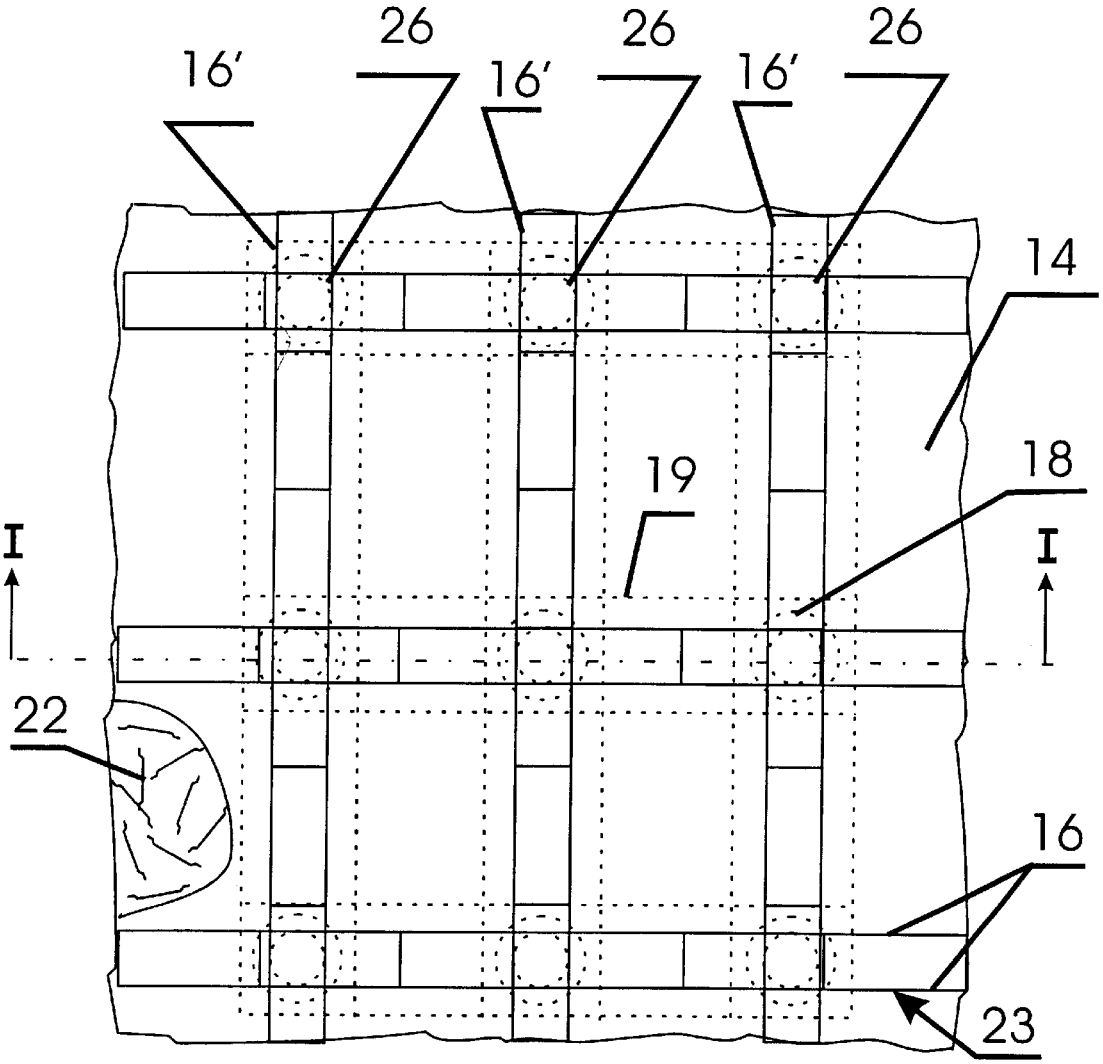
FIG. 2 is a cross-sectional view of the fixed construction according to line II—II of FIG. 1

FIG. 2 illustrates where the rod reinforcement is located in the floor slab 14. Steel rods 16, running lengthwise, and steel rods 16', running broadwise, connect the shortest distance above those areas 18 of the floor slab which are situated above the piles 12. So the steel rods not only reinforce the limited areas 18 above the piles 12 but also the straight zones 19 between the piles 12. As has been explained hereabove, the moments occurring between the piles are not as high as those occuring in the zones above the piles (only 35% of the peak moments above the piles). Experiments have proved that reinforcing the straight zones 19 between the piles by means of the steel rods, as in the present invention, helps to stop and limit cracks which are a consequence of shrinkage of the concrete of the floor slab or which are a consequence of loads on the floor slab. More particularly, reinforcing the straight zones 19 between the piles and placing the floor slab under increasing loads, leads to a pattern where the cracks are more spread and multiplied in comparison with a floor slab where only steel fibres are present as reinforcement. Due to this spreading and multiplication, the cracks are limited and are less harmful.

According to FIG. 2, steel fibres or fibers 22 are distributed, preferably as uniformly as possible in the two horizontal directions over the whole volume of the floor slab 14.

As may be derived from FIG. 2, the present invention makes efficient use of both reinforcement means: the steel rods 16 and the steel fibres 22. In the most critical zone (peak moments=100%), namely area 18 above the piles, the steel rods 16 are present in a double way since they cross each other and steel fibres 22 are present. In the second most critical zone (moments=35% of the peak moments above the piles), namely the straight zones 19 between the piles, steel rods 16 (in a single way) and steel fibres 22 are present. Outside the area 18 and outside the straight zones 19 (moments=only 20% of the peak moments above the piles) only steel fibres 22 are present.

Figure 3:
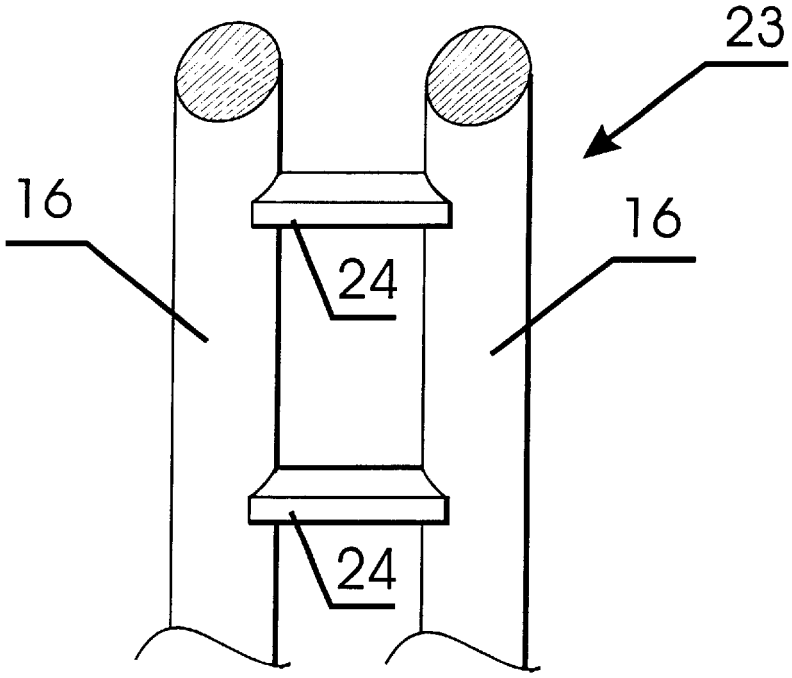
FIG. 3 is a perspective view of a bi-steel strip.

FIG. 3 gives a perspective view of a bi-steel strip 23 made from two parallel wire rods 16. The parallel wire rods 16 are connected by means of transverse flat steel elements 24 which are welded to the wire rods 16.

Figure 4:
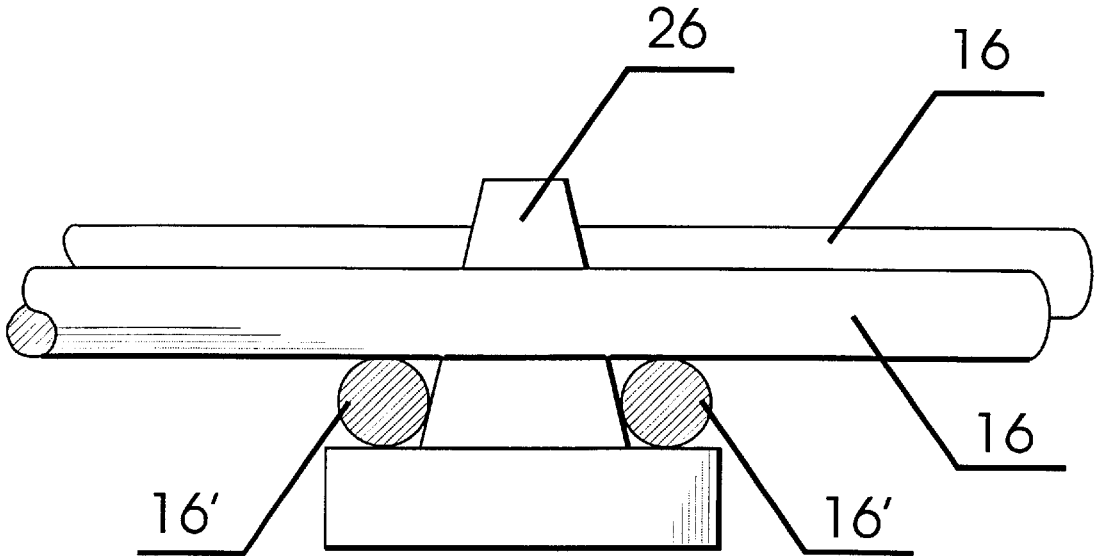
FIG. 4 shows how bi-steel strips can be supported by means of a spacer.

FIG. 4 illustrates how steel rods 16 and 16' are placed and supported by means of a spacer 26 which can be made of a synthetic material.

Coming back to FIG. 2, a fixed construction 10 according to the invention can be made as follows. Rigid piles 12 are driven or bored into the natural ground 13. The natural ground 13 is leveled and plastic spacers 26 are placed in the areas 18 above the piles 12. Normally, two to three spacers 26 are used every meter or four to five spacers 26 are used every square meter. The bi-steel strips 23 are placed above the spacers 26 as illustrated in FIG. 4. Finally, concrete with steel fibres 22 is pumped and poured over the designed area.

The concrete used may be conventional concrete varying from C20/25 to C40/50 according to the European norms (EN 206). The characteristic compressive strength after 28 days of such a concrete varies between 20 MPa and 40 MPa if measured on cylinders (300×Ø150 mm ) and between 25 and 50 MPa if measured on cubes (150×150×150 mm).

After being poured the concrete is first leveled and then left to harden. The finishing operation may comprise the power floating of the surface in order to obtain a flat floor with a smooth surface and may also comprise applying a topping (e.g. dry shake material) over the hardening floor slab and curing the surface by means of waxes (curing compounds) . The hardening may take fourteen days or more during which no substantial loads should be put on the floor slab.

In comparison with a concrete floor slab where only steel fibres have been used as a reinforcement, a fixed construction according to the invention has led to a construction with an increased bearing capacity and/or to a construction where the distance between the supporting piles may be increased.

The inventors have discovered that with the combination reinforcement according to the invention, there is no need to place additional reinforcements such as still some more steel rods or steel meshes in the areas of the floor slab above the piles.

The inventors have also discovered that with the combination reinforcement according to the invention there is no need to construct the piles with an increased cross-section at their top and that there is neither a need to construct separate pile heads with an increased cross-section.

Such increased cross-sections just under the floor slab are used in existing constructions to diminish the transversal forces of loads on the slab. The present invention decreases this necessity.

In comparison with a combination reinforcement of steel rebars of conventional yield strength and steel fibres, the present invention allows to decrease the volume of steel rods required by an amount ranging from 2% to 15% and more, depending upon the particular floor to be reinforced.

What is claimed is:

1. A fixed constructions, comprising:

a) rigid piles and a monolithic concrete floor slab resting on said piles, said rigid piles being arranged in a regular rectangular pattern where each set of four piles forms a rectangles;

b) said floor slab comprising straight zones connecting in both the lengthwise and broadwise directions, the shortest distance between those areas of the floor slab above the piles;

c) said floor slab being reinforced by a combination of:

i) fibres being distributed over the volume of said floor slab; and ii) steel rods having a yield strength of at least 690 MPa and being located only in said straight zones.

2. A fixed construction according to claim 1 wherein said steel rods are arranged in pairs.

3. A fixed construction according to claim 2 wherein one of said pairs is located in each of said straight zones.

4. A fixed construction according to claim 2 wherein the rods of each pair are transversely connected with each other by means of a transverse steel element.

5. A fixed construction according to claim 1 wherein said rods are supported by means of a spacer.

6. A fixed construction according to claim 1 wherein said floor slab is a jointless floor slab.

7. A fixed construction according to claim 1 wherein said floor slab directly rests on said piles.

8. A fixed construction according to claim 1 wherein said fibres are steel fibres.

9. A fixed construction according to claim 1 wherein said steel rods occupy up to 0.4% of the total volume of said floor slab.

10. A fixed construction according to claim 8 wherein said steel fibres occupy at most 60 kg/m$^3$ (=0.75 volume %) of the floor slab.

11. A fixed construction according to claim 8 wherein said steel fibres and said steel rods together occupy at most 1.5 volume % of the floor slab.

12. A fixed construction according to claim 3, wherein the rods of each pair are transversely connected with each other by means of a transverse steel element.

13. A fixed construction according to claim 2 wherein said rods are supported by means of a spacer.

14. A fixed construction according to claim 2 wherein said floor slab is a jointless floor slab.

15. A fixed construction according to claim 2 wherein said floor slab directly rests on said piles.

16. A fixed construction according to claim 2 wherein said fibres are steel fibres.

17. A fixed construction according to claim 2 wherein said steel rods occupy up to 0.4% of the total volume of said floor slab.

18. A fixed construction according to claim 9 wherein said steel fibres occupy at most 60 kg/m$^3$ (=0.75 volume %) of the floor slab.

19. A fixed construction, comprising:

a) rigid piles;

b) a concrete floor slab resting on the rigid piles;

c) four of the rigid piles being arranged in a rectangular pattern;

d) straight zones extending between adjacent ones of the four piles, the straight zones extending in lengthwise and broadwise directions;

e) fibers being distributed throughout the volume of the concrete floor slab; and f) steel rods having a yield strength of at least about 690 MPa being provided in the floor slab, the steel rods being located only in the straight zones.

20. A fixed construction according to claim 19, wherein:

a) said steel rods include pairs of steel rods.

21. A fixed construction according to claim 19, wherein:

a) the concrete floor slab rests directly on the piles.

22. A fixed construction according to claim 19, wherein:

a) the fibers are steel fibers.

* * * * *